US008925915B2

(12) United States Patent
Watanabe

(10) Patent No.: US 8,925,915 B2
(45) Date of Patent: Jan. 6, 2015

(54) SHEET SUPPLY DEVICE

(71) Applicant: Riso Kagaku Corporation, Tokyo (JP)

(72) Inventor: Hiroshi Watanabe, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/146,247

(22) Filed: Jan. 2, 2014

(65) Prior Publication Data

US 2014/0191464 A1 Jul. 10, 2014

(30) Foreign Application Priority Data

Jan. 10, 2013 (JP) ..... 2013-002548

(51) Int. Cl.
*B65H 1/04* (2006.01)

(52) U.S. Cl.
CPC ..... *B65H 1/04* (2013.01)
USPC ..... 271/171

(58) Field of Classification Search
USPC ..... 271/171; 399/393
See application file for complete search history.

(56) References Cited

U.S. PATENT DOCUMENTS 5,022,137 A * 6/1991 Sorensen et al. ..... 29/559
5,586,757 A * 12/1996 Nakamatsu et al. ..... 271/145

FOREIGN PATENT DOCUMENTS

JP 05319585 A * 12/1993 ..... B65H 1/04
JP 06-072995 10/1994

OTHER PUBLICATIONS

Machine translation of JP 05319585 A, retrieved May 16, 2014.*

* cited by examiner

*Primary Examiner* — Michael McCullough
(74) *Attorney, Agent, or Firm* — Hamre, Schumann, Mueller & Larson, P.C.

(57) ABSTRACT

A sheet supply device includes a sheet supply tray, a guide fence for restricting sheets along a sheet width direction, a slider block that is slidable along the sheet width direction and supports the guide fence in an upright state, a slide shaft that is inserted into a through hole formed in the slider block and guides sliding of the slider block, and a guide fence lock mechanism including a restriction member on which a hole is formed and that is attached to the slider block swingably (the slide shaft is inserted into the hole). The guide fence lock mechanism restricts sliding of the slider block by holding the restriction member in a lock state where an inner circumferential edge of the hole is pushed onto an outer circumference of the slide shaft, and allows sliding of the slider block when the restriction member is swung to cancel the lock state.

10 Claims, 8 Drawing Sheets

SHEET SUPPLY DEVICE

BACKGROUND OF THE INVENTION

1. Technical Field

The present invention relates to a sheet supply device to be provided in an image forming apparatus.

2. Background Arts

Generally, an image forming apparatus such as a stencil printing machine includes a sheet supply device for supplying print sheets to an image forming unit. Such a sheet supply device includes a sheet supply tray on which print sheets are stacked. An entire of a sheet supply tray can be retracted-into and drawn-from a main body of the apparatus. Alternatively, a portion of a sheet supply tray may be extended outward from an opening of a main body of the apparatus.

Such a sheet supply device includes a guide fence(s) for restricting positions of print sheets along a sheet width direction perpendicular to a sheet supply direction. The guide fence(s) can be moved manually along the sheet width direction according to a size of print sheets. In addition, the sheet supply device also includes a guide fence mechanism for locking the guide fence(s).

Various types of lock mechanisms are proposed. For example, Japanese Utility Model Application Laid-Open No. H6-72995 discloses a guide fence mechanism for a pair of guide fences that regulates a width between side edges of print sheets stacked on a sheet supply tray. The guide fences can be moved independently from each other. Each of the guide fences is provided with a lock lever having an eccentric cam. Movement of each of the guide fences is restricted when the lock lever is operated.

SUMMARY OF THE INVENTION

When setting large-sized print sheets (e.g. A3 size print sheets) on a sheet supply tray, it may be needed to divide the print sheets into several bundles and then stack the several bundles one by one due to heavy weight of all the print sheets. In such a case, edges of the bundles are more likely to become uneven with respect to each bundle. Therefore, it is required to align the edges of the stacked print sheets (bundles) by guide fences in order to make the edges even.

If a locking (restriction) force of any one of the guide fences is insufficient against an impact force generated by aligning the print sheets, supply positions of the print sheets may become erroneously shifted laterally (in a sheet width direction). In a case of strengthening such a locking force to avoid such an erroneous supply of the print sheets in the prior art as instantiated above, it may be required to increase an eccentric amount of the eccentric cam of the guide fence mechanism in order to increase friction applied to the eccentric cam. Therefore, an operational force of the lock lever may become larger and thereby operability of the guide fence mechanism may become degraded.

An object of the present invention is to provide a sheet supply device that can strengthen a locking force of the guide fence(s) and can improve operability for changing a position(s) of a guide fence(s) on a sheet supply tray.

An aspect of the present invention provides a sheet supply device that includes a sheet supply tray on which sheets are stacked; a guide fence for restricting positions of the sheets along a sheet width direction perpendicular to a sheet supply direction; a slider block that is slidable along the sheet width direction and supports the guide fence in an upright state; a slide shaft that is inserted into a through hole formed in the slider block and guides sliding of the slider block along the sheet width direction; and a guide fence lock mechanism including a restriction member on which a hole is formed and that is attached to the slider block swingably at a position distanced from the guide fence, the slide shaft being inserted into the hole, wherein the guide fence lock mechanism is configured to restrict sliding of the slider block along the sheet width direction by holding the restriction member in a lock state where an inner circumferential edge of the hole is pushed onto an outer circumference of the slide shaft, and to allow sliding of the slider block along the sheet width direction when the restriction member is swung to cancel the lock state.

According to the above aspect, a friction force is generated between the inner circumferential edge of the hole and the outer circumference of the slide shaft when the inner circumferential edge is pushed onto the outer circumference in the lock state. Sliding of the guide fence is locked by the friction force. Therefore, an operational force can be prevented from increasing in comparison with a sheet supply device including a guide fence mechanism using an eccentric cam. In addition, a locking force for the guide fence can be strengthened and operability for changing positions of the guide fence can be also improved.

It is preferable that the guide fence mechanism further includes a fulcrum plate that is fixed with a vertical end of the slider block and engaged with a vertical end of the restriction member so as to function as a fulcrum when the restriction member is swung, an elastic member that is disposed near another vertical end of the slider block and to urge the restriction member toward the guide fence, and a lever that is fixed with another vertical end of the restriction member and configured to swing the restriction member when manually operated to distance the restriction member away from the guide fence against an urging force of the elastic member.

According to this configuration, it become possible by this relatively simple configuration to strengthen the locking force for the guide fence and improve the operability for changing positions of the guide fence. In addition, a pushing force is applied to the guide fence by aligning sheets stacked on the sheet supply tray. The pushing force is transmitted to the restriction member via the fulcrum plate, so that the inner circumferential edge of the hole is further pressed onto the outer circumference of the slide shaft. Therefore, the above-explained friction force is strengthened and thereby the guide fence can be made locked more firmly.

DESCRIPTION OF THE EMBODIMENTS

Figure 1:
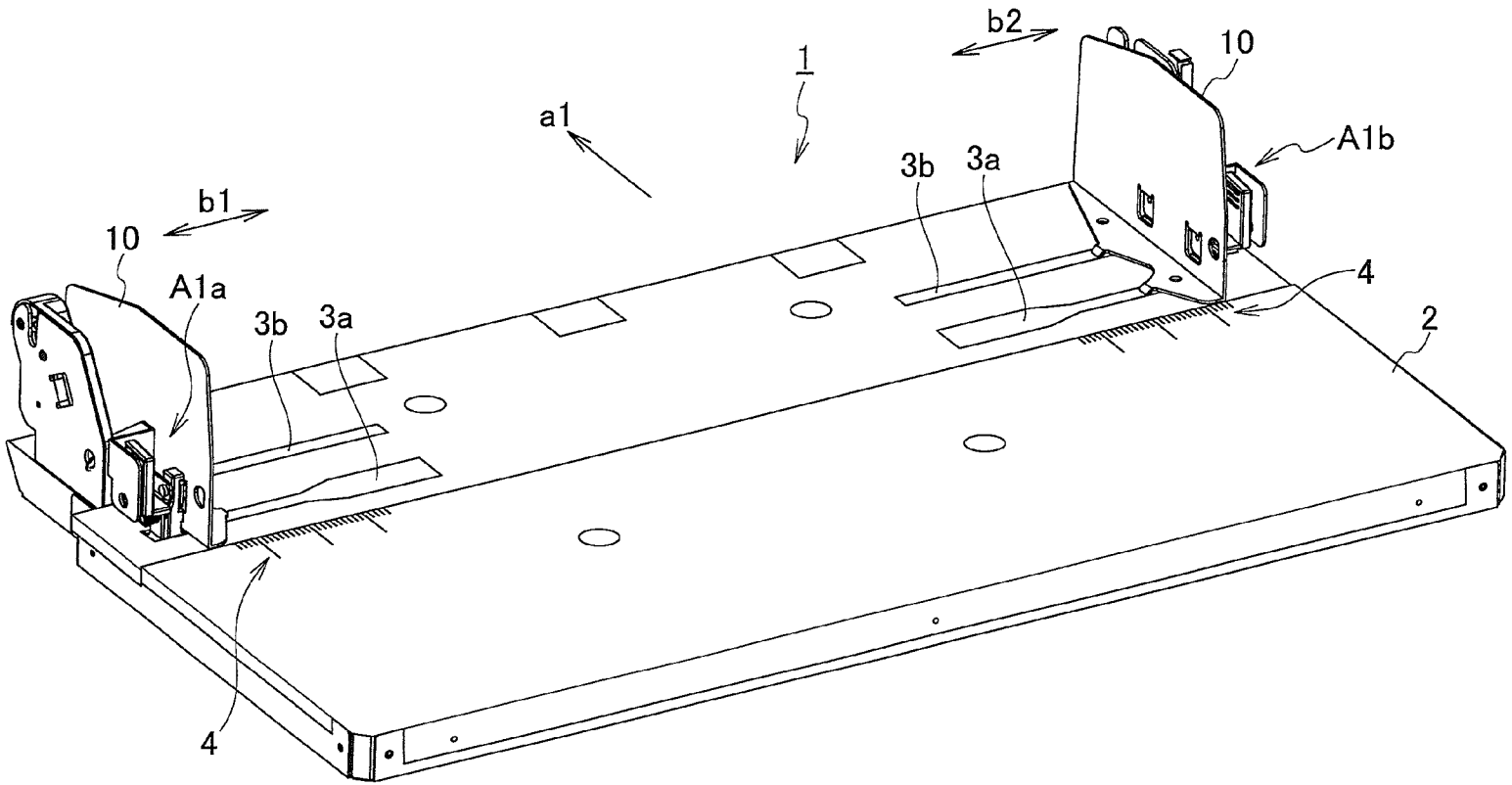
FIG. 1 is a perspective view of a sheet supply device according to an embodiment.

Hereinafter, an embodiment will be explained with reference to the drawings. In the drawings, identical or equivalent components are indicated by identical reference numbers, respectively, and thereby redundant explanations for them are omitted.

<Overall Configuration of Sheet Supply Device>

As shown in FIG. 1, a sheet supply device 1 according to the present embodiment includes a sheet supply tray 2 for stacking print sheets, and a pair of guide fences 10 for restricting positions of the print sheets along a sheet width direction b1 and b2 perpendicular to a sheet supply direction a1.

The sheet supply tray 2 is made of resin, and guide slots 3*a* and 3*b* for guiding movements of the guide fences 10 are formed on an upper surface of the sheet supply tray 2 along the sheet width direction b1 and b2. In addition, scales 4 are marked on the upper surface along the guide slots 3*a*, respectively, and used as reference for setting positions of the guide plates 10. The guide fences 10 include guide fence mechanisms A1*a* and A1*b*, respectively, and positions of the guide fences 10 are made fixed at desired positions by the guide fence lock mechanisms A1*a* and A1*b*, respectively.

In addition, as shown in FIGS. 1 to 5, the sheet supply device 1 includes a pair of symmetrical units that include the guide fence lock mechanisms A1*a* and A1*b*, respectively. Each of the unit includes a slider block 11 that supports the guide fence 10 in an upright state and is slidable along the sheet width direction b1 or b2, and a slide shaft 20 that is inserted into a through hole 11*a* formed in the slider block 11 and guides the slider block 11 slidably along the sheet width direction b1 (b2). The guide fence lock mechanism A1*a* (A1*b*) is disposed at a position distanced from the guide fence 10.

Figure 4:
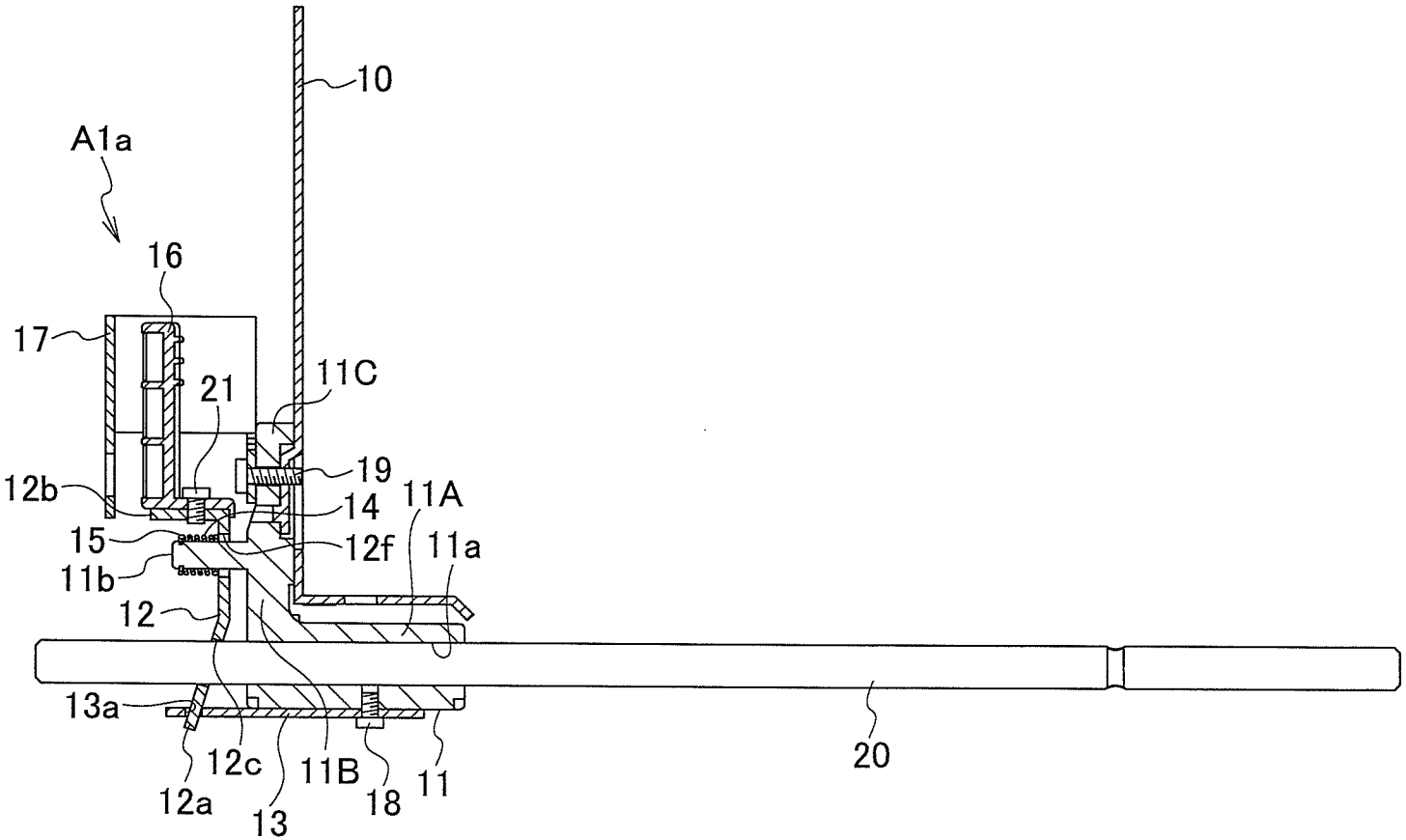
FIG. 4 is a cross-sectional view of the guide fence mechanism.
Figure 5:
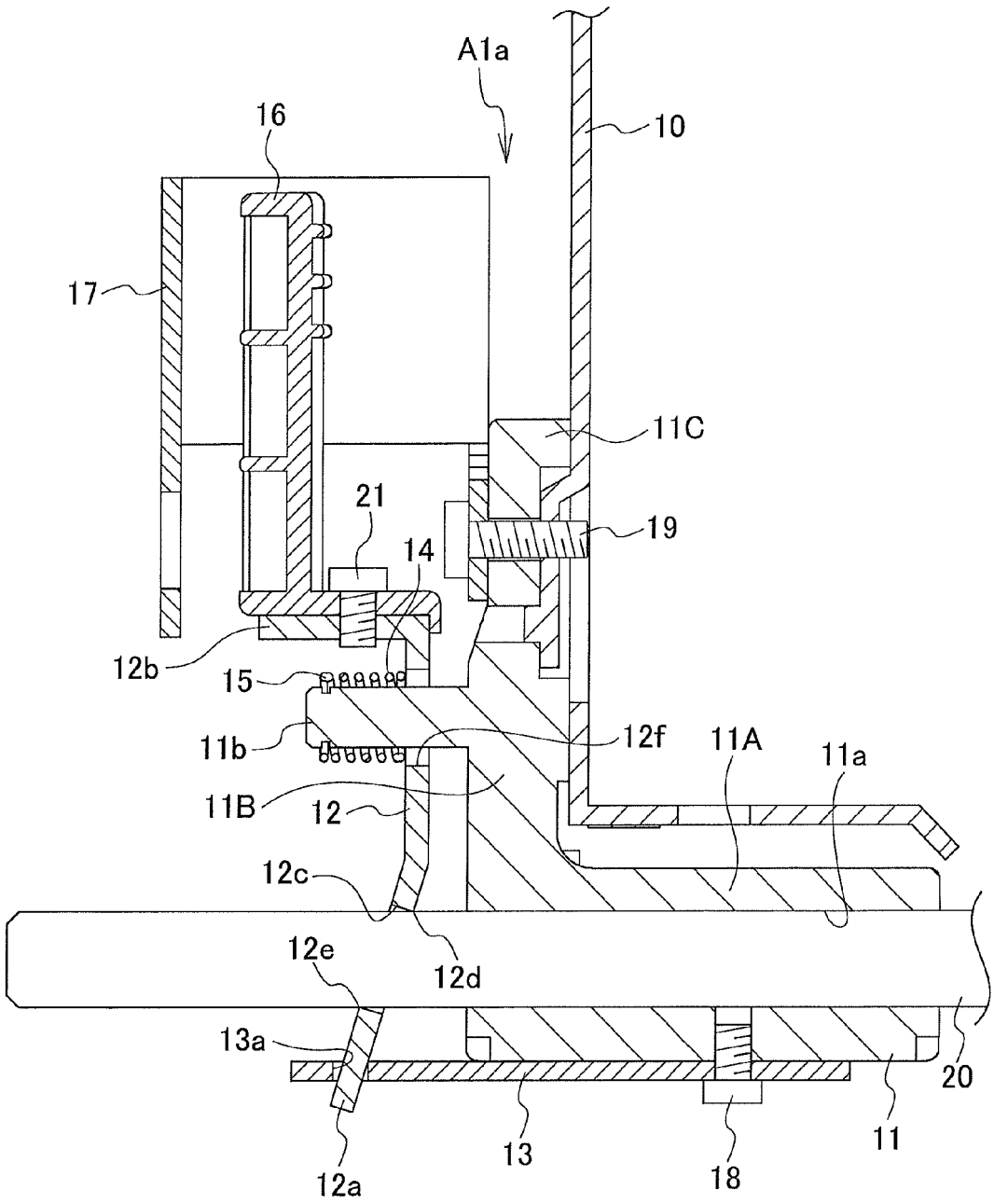
FIG. 5 is an enlarged cross-sectional view of the guide fence mechanism.

As shown in FIGS. 4 and 5, the slider block 11 includes a cylindrical portion 11A in which the through hole 11*a* is formed, a vertical portion 11B extended vertically upward from one end (a left end in FIGS. 4 and 5) of the cylindrical portion 11A, and an attachment portion 11C extended vertically upward further from an upper end of the vertical portion 11B. The guide fence 10 is fixed with the attachment portion 11C by a screw 19. Note that a boss (protrusion) 11*b* that is part of the guide fence lock mechanism A1*a* (A1*b*) is formed on the vertical portion 11B (the boss 11*b* will be explained later in detail). The slider block 11 is made of die-cast aluminum, resin and so on. An inner diameter of the through hole 11*a* is made slightly larger than an outer diameter of the slide shaft 20.

Figure 2:
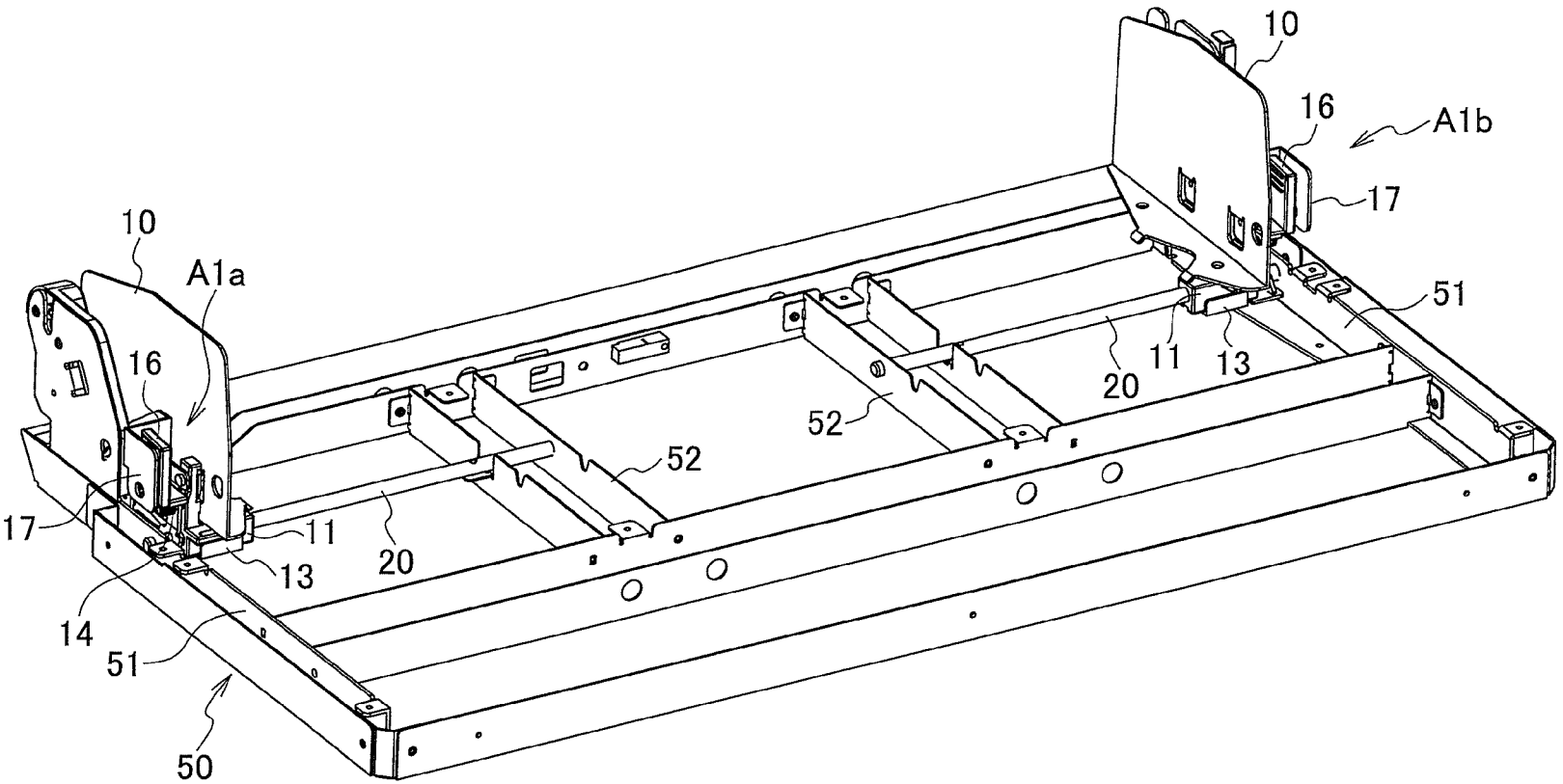
FIG. 2 is a perspective view showing an inside of the sheet supply device.

As shown in FIG. 2, a frame 50 configured by sheet metals or the like is provided within the sheet supply tray 2. The slide shafts 20 are fixed between beam members 51 and 52 that are part of the frame 50, respectively. The slide shaft(s) 20 is made from a stainless steel shaft (outer diameter: 8 mm), for example. The slide shaft(s) 20 is inserted into the through hole 11*a* formed in the cylindrical portion 11A of the slider block 11.

According to the above-explained configuration, the slider blocks 11 can smoothly slide in the sheet width direction b1 and b2 along the slide shafts 20 inserted into the through holes 11*a*, respectively. Along with sliding of the slider blocks 11, the guide fences 10 are shifted in the sheet width direction b1 and b2 (see FIG. 1). Therefore, the guide fences 10 can be shifted to positions adequate for a sheet width while their lock states by the guide fence lock mechanisms A1*a* and A1*b* are cancelled. Note that, as shown in FIGS. 4 and 5, a pinch plate 17 is fixed with the attachment portion 11C together with the guide fence 10 by the screw 19 in the present embodiment (the pinch plate 17 will be explained later).

Figure 6A:
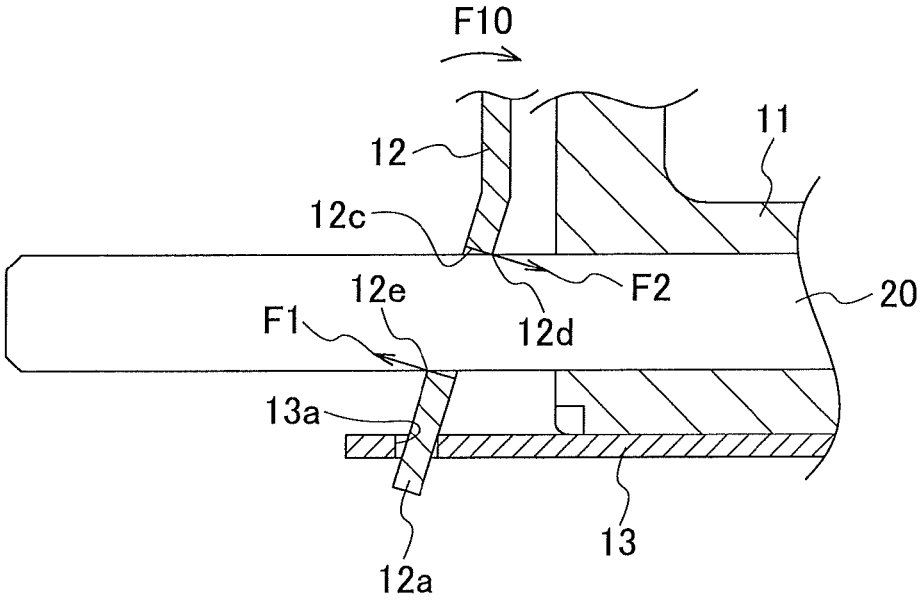
FIG. 6A is a partially enlarged cross-sectional view of the guide fence mechanism (lock state: only an urging force of a coil spring is applied)
Figure 6B:
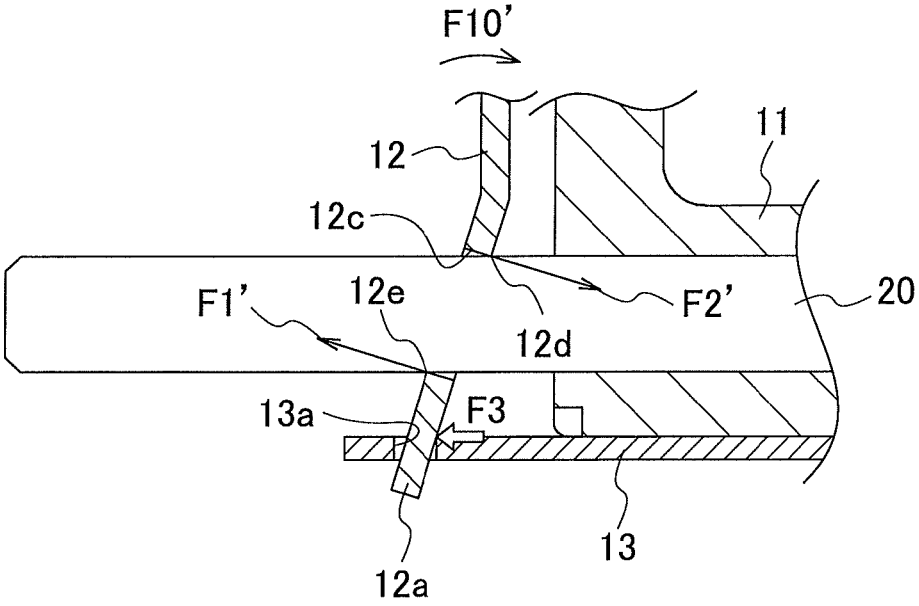
FIG. 6B is a partially enlarged cross-sectional view of the guide fence mechanism (lock state: a pushing force by print sheets is applied)
Figure 8:
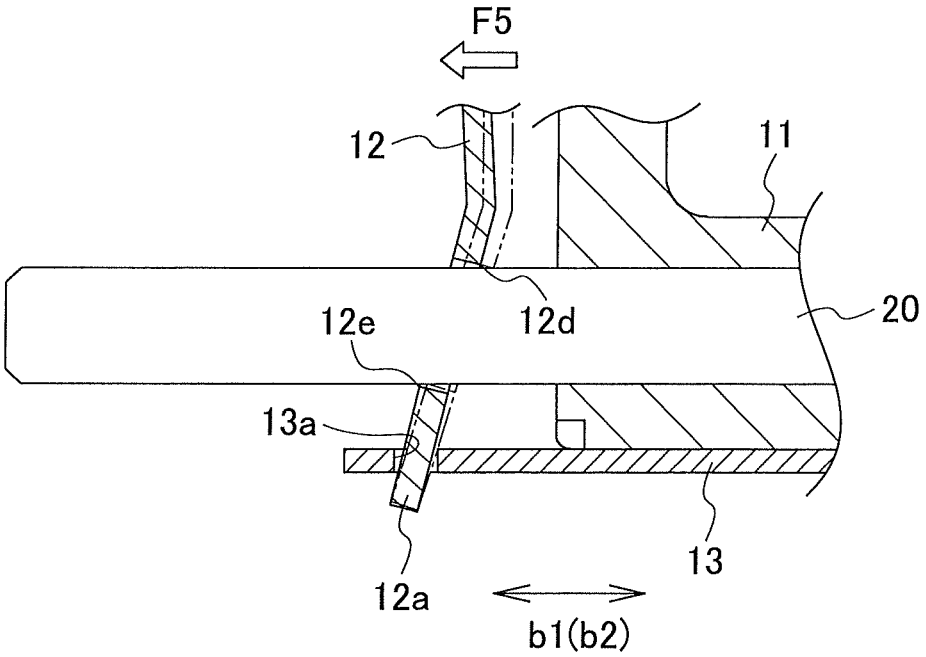
FIG. 8 is a partially enlarged cross-sectional view of the guide fence mechanism (unlocked state shown by solid lines/lock state shown by dashed-two-dotted lines).

In addition, the guide fence lock mechanism A1*a* (A1*b*) includes a restriction plate (restriction member) 12 on which a hole 12*c* is formed. The hole 12*c* has a larger inner diameter than the outer diameter of the slide shaft 20, and the slide shaft 20 can be loosely inserted into the hole 12*c*. While the stacked print sheets are restricted by the guide fence(s), inner circumferential sharp edges 12*d* and 12*e* of the hole 12*c* is pushed (clenched) onto an outer circumferential surface of the slide shaft 20 by pushing forces F1 and F2 (FF and F2') to hold the guide fences 10 as shown in FIGS. 6A and 6B (a lock state). When the position of the guide fence(s) 10 is to be sifted, the pushing forces F1 and F2 (F1' and F2') are released (cancelled) as shown in FIG. 8. The pushing forces F1 and F2 (F1' and F2') will be explained later in detail.

<Configuration of Guide Fence Lock Mechanism>

Figure 3:
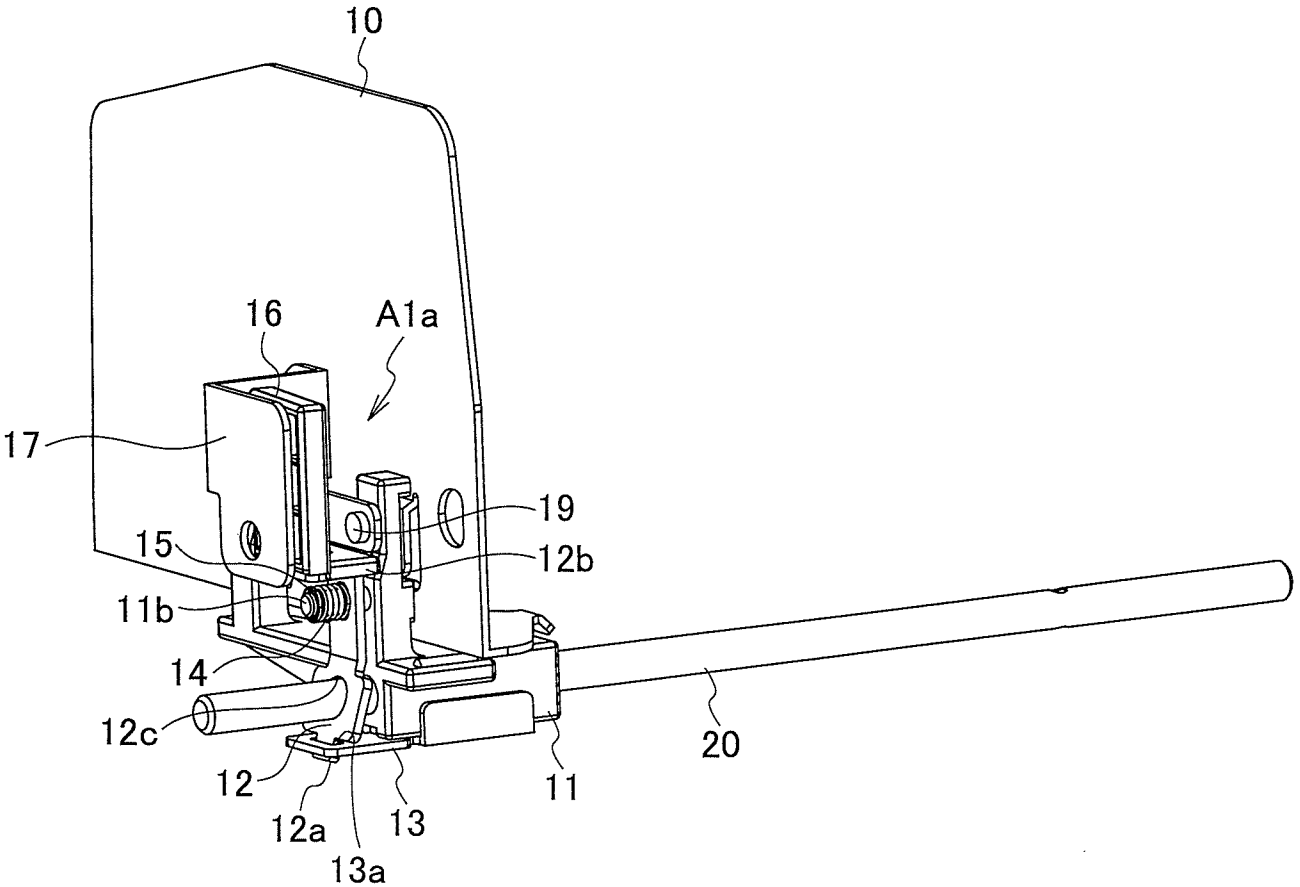
FIG. 3 is a perspective view of a guide fence mechanism in the sheet supply device.

Next, configurations of the guide fence lock mechanisms A1*a* and A1*b* will be explained with reference to FIGS. 3 to 5. Note that the guide fence lock mechanisms A1*a* and A1*b* are identical (symmetric) to each other in the present embodiment. Hereinafter, the guide fence lock mechanism A1*a* will be explained as a representative of them.

The guide fence lock mechanism A1*a* includes the restriction plate 12, a fulcrum plate 13, a coil spring (an elastic member) 14, and a lever 16. The restriction plate 12 is made by bending SECC (electrolytic zinc-coated steel plate) or the like. The fulcrum plate 13 is fixed with a vertical end (a lower end in FIGS. 3 to 5) of the cylindrical portion 11A of the slider block 11. An engagement hole 13*a* is formed on the fulcrum plate 13. The engagement hole 13*a* is engaged with a vertical end (a lower end in FIGS. 3 to 5) 12*a* of the restriction plate 12 to function as a fulcrum when the restriction plate 12 is swung. The boss 11*b* of the of the slider block 11 is inserted into the coil spring 14, and the coil spring 14 urges the restriction plate 12 toward the guide fence 10. The lever 16 is fixed with another vertical end (an upper end in FIGS. 3 to 5) of the restriction plate 12, and is configured to swing the restriction plate 12 when manually operated to distance the restriction plate 12 away from the guide fence 10 against an urging force of the coil spring 14.

As shown in FIGS. 4 and 5, the lever 16 in the present embodiment is made of resin to have an almost L-shaped cross-section when viewed from its front. In addition, the boss 11*b* is monolithically protruded from a surface of the vertical portion 11B toward an opposite side to the guide fence 10 so as to be parallel to the slide shaft 20. Further, a through hole 12*f* is formed on the restriction plate 12, and the boss 11*b* is inserted into the through hole 12*f* (see FIGS. 4 and 5).

An E-ring (E-shaped stopper ring) 15 is attached to an end of the boss 11*b* to hold the coil spring 14. The coil spring 14 is disposed between the E-ring 15 and the restriction plate 12 in a half-compressed state so as to urge the restriction plate 12 as explained above. In addition, the pinch plate 17 is formed by bending a sheet metal or the like, and pinched together with the lever 16 by a hand to swing the restriction plate 12 (to unlock the guide fence lock mechanism A1*a*).

As shown in FIG. 4, the pinch plate 17 is fixed with the attachment portion 11C of the slider block 11 and the guide fence 10 by the screw 19. The slider block 11 and the guide fence 10 are integrally fixed with each other by the screw 19. In addition, the fulcrum plate 13 is fixed with the slider block 11 by a screw 18. Further, the lever 16 is fixed with an upper flange 12*b* of the restriction plate 12. The upper flange 12*b* is extended horizontally at another end (an upper end) of the restriction plate 12.

<Operations of Guide Fence Lock Mechanism>

Operations of the guide fence lock mechanism A1*a* (A1*b*) will be explained with reference to FIGS. 6A to 8. To begin with, a lock state of the guide fence lock mechanism A1*a* will be explained with reference to FIGS. 6A and 6B. FIG. 6A shows the lock state where only the urging force of the coil spring 14 is applied to the restriction plate 12. FIG. 6B shows the lock state where a pushing force F3 is also applied to the restriction plate 12 from print sheets via the guide fence 10 in addition to the urging force of the coil spring 14.

In FIG. 6A, only the urging force of the coil spring 14 is applied to the restriction plate 12. A rotating force F10 is generated by the urging force so as to swing the restriction plate 12 toward the guide fence 10 while the engagement hole 13*a* functions as a fulcrum. By the rotating force F10, the sharp inner circumferential edges 12*d* and 12*e* of the hole 12*c* are pushed (clenched) onto the outer circumferential surface of the slide shaft 20. Namely, due to the rotating force F10, a pushing force by a vector F2 shown in FIG. 6A is applied to a contacting portion between the inner circumferential edge 12*d* and the outer circumferential surface of the slide shaft 20. Similarly, another pushing force by a vector F1 shown in FIG. 6A is applied to a contacting portion between the inner circumferential edge 12*e* and the outer circumferential surface of the slide shaft 20. By friction forces generated at the contacting portions between the sharp inner circumferential edges 12*d* and 12*e* and the outer circumferential surface of the slide shaft 20 due to the pushing forces (vectors F1 and F2), the guide fence 10 is made locked.

Next, explained will be the other lock state where the pushing force F3 is applied to the restriction plate 12 from sprint sheets via the guide fence 10, the slider block 11 and the fulcrum plate 13 as shown in FIG. 6B. When setting large-sized print sheets (e.g. A3 size print sheets) on the sheet supply tray 2 (see FIG. 1), it may be needed to divide the print sheets into several bundles and then stack the several bundles one by one due to heavy weight of all the print sheets. In such a case, edges of the bundles are more likely to become uneven with respect to each bundle. Therefore, it is required to align the edges of the stacked print sheets (bundles) in order to make the edges even. When a pushing force generated by aligning the edges is applied to the guide fence 10, the pushing force F3 is applied to the lower end of the restriction plate 12 via the guide fence 10, the slider block 11 and the fulcrum plate 13.

A rotating force F10' is generated by the pushing force F3 and the above-explained urging force of the coil spring 14 so as to swing the restriction plate 12 toward the guide fence 10 while the engagement hole 13*a* functions as a fulcrum. Therefore, the sharp inner circumferential edges 12*d* and 12*e* of the hole 12*c* are further pushed (clenched) onto the outer circumferential surface of the slide shaft 20. Namely, due to the rotating forces F10', a pushing force by a vector F2' shown in FIG. 6B is applied to the contacting portion between the inner circumferential edge 12*d* and the outer circumferential surface of the slide shaft 20. Similarly, another pushing force by a vector F1' shown in FIG. 6B is applied to the contacting portion between the inner circumferential edge 12*e* and the outer circumferential surface of the slide shaft 20. By larger friction forces generated at the contacting portions due to the pushing forces (vectors F1' and F2'), the guide fence 10 is made locked more firmly than in the lock state shown in FIG. 6A.

Figure 7:
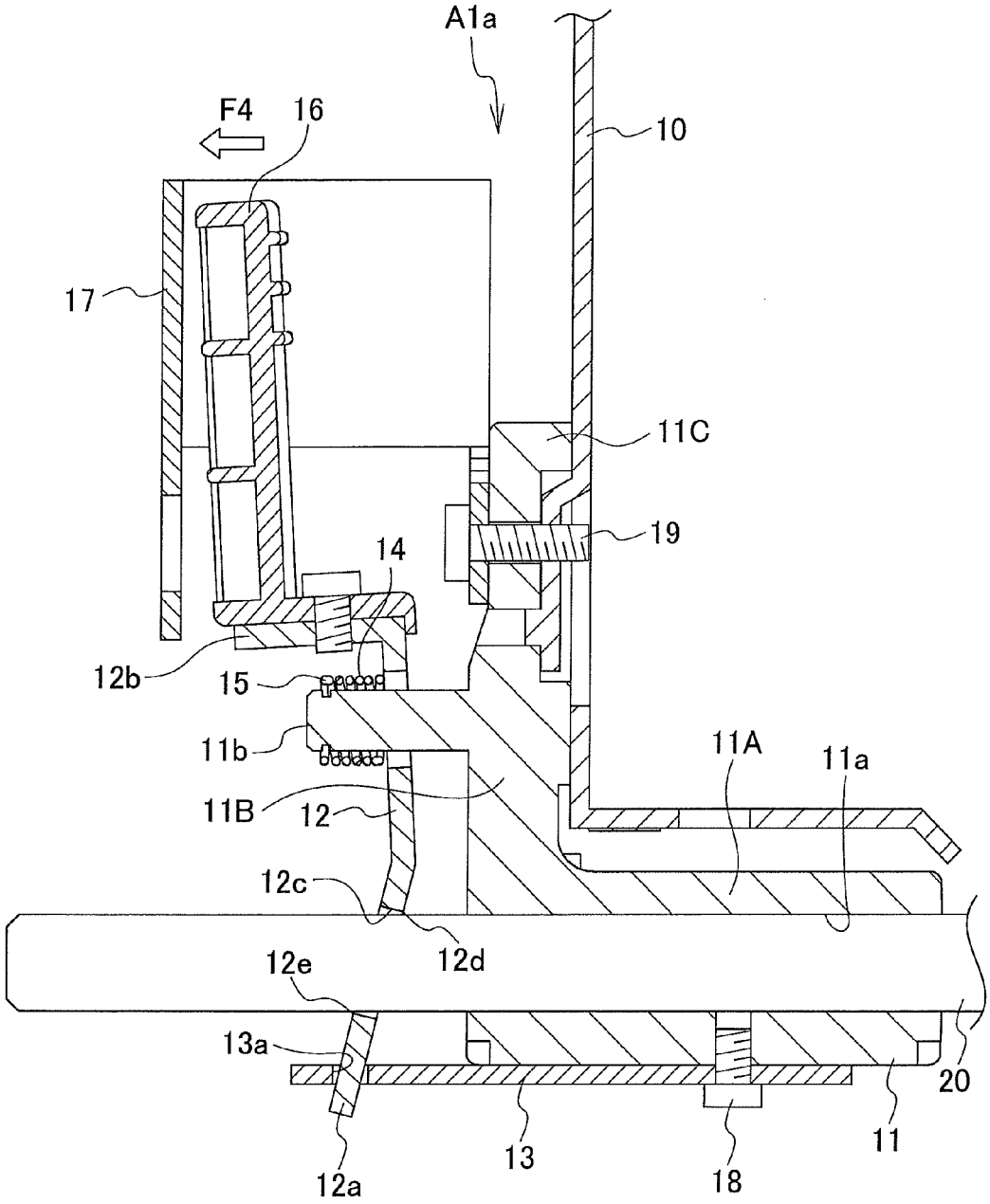
FIG. 7 is an enlarged cross-sectional view of the guide fence mechanism (unlock state)

An operation for unlocking the guide fence mechanism A1*a* (A1*b*) will be explained with reference to FIGS. 7 and 8. When unlocking the guide fence mechanism A1*a* (A1*b*), the lever 16 is manually operated so as to be distanced away from the guide fence 10 as shown in FIG. 7. Practically, the lever 16 and the pinch plate 17 are pinched together by a hand, so that a pinching force F4 is generated to distance the lever 16 away from the guide fence 10.

As shown in FIG. 8, a rotating force F5 is generated by the pinching force F4 so as to swing the restriction plate 12 toward an opposed side to the guide fence 10 while the engagement hole 13*a* functions as a fulcrum, so that the above-explained lock state is cancelled (an unlock state). While the lock state is cancelled (i.e. during the unlock state), the slide shaft 20 is loosely inserted into the hole 12*c* of the restriction plate 12. Therefore, the guide fence 10 can be slid smoothly to a desired position appropriate to a width of print sheets along the sheet width direction b1 (b2) by shifting the guide fence 10 while holding the lever 16 in the above-explained pinched state as shown in FIG. 7.

As explained above, according to the guide fence mechanisms A1*a* and A1*b* included in the sheet supply device 1 in the present embodiment, an operational force can be prevented from increasing in comparison with a sheet supply device including a guide fence mechanism using an eccentric cam. In addition, locking forces for the guide fences 10 can be strengthened and operability for changing positions of the guide fences 10 can be also improved.

The present invention is not limited to the above-mentioned embodiment, and it is possible to embody the present invention by modifying its components in a range that does not depart from the scope thereof. Further, it is possible to form various kinds of inventions by appropriately combining a plurality of components disclosed in the above-mentioned embodiment. For example, it may be possible to omit several components from all of the components shown in the above-mentioned embodiment. Scope of the present invention is determined in the context of the claims.

For example, the guide fences 10 provided with the guide fence mechanisms A1*a* and A1*b* are provided on both sides of the sheet supply direction in the above embodiment as shown in FIG. 1. However, a guide fence mechanism may be provided only for one of the guide fences 10, and another of the guide fences 10 may be provided fixedly.

The guide fences 10 provided with the guide fence mechanisms A1*a* and A1*b* are implemented in the sheet supply tray 2 of the sheet supply device 1 as shown in FIG. 1 (e.g. manual sheet supply). However, the guide fences 10 provided with the guide fence mechanisms A1*a* and A1*b* can be applied to a sheet supply drawer (that is one type of sheet supply tray) (e.g. automatic sheet supply).

The friction forces between the inner circumferential edges 12*d* and 12*e* and the outer circumferential surface of the slide shaft 20 may be increased by roughening the outer circumferential surface of the slide shaft 20, by engraving grooves on the outer circumferential surface of the slide shaft 20, or the like.

The present application claims the benefit of a priority under 35 U.S.C §119 to Japanese Patent Application No. 2013-2548, filed on Jan. 10, 2013, the entire content of which is incorporated herein by reference.

What is claimed is:

1. A sheet supply device comprising:

a sheet supply tray on which sheets are intended to be stacked;

a guide fence for restricting positions of the sheets along a sheet width direction perpendicular to a sheet supply direction;

a slider block that is slidable along the sheet width direction and supports the guide fence in an upright state;

a slide shaft that is inserted into a through hole formed in the slider block and guides sliding of the slider block along the sheet width direction; and a guide fence lock mechanism including a restriction member on which a hole is formed, the guide fence lock mechanism being attached to the slider block swingably at a position distanced from the guide fence, the slide shaft being inserted into the hole, wherein the guide fence lock mechanism is configured to restrict sliding of the slider block along the sheet width direction by holding the restriction member in a lock state where an inner circumferential edge of the hole is pushed onto an outer circumference of the slide shaft, and to allow sliding of the slider block along the sheet width direction when the restriction member is swung to cancel the lock state.

2. The sheet supply device according to claim 1, wherein the guide fence lock mechanism further includes a fulcrum plate that is fixed with a first vertical end of the slider block and engaged with a first end of the restriction member so as to function as a fulcrum when the restriction member is swung, an elastic member that is disposed near a second vertical end of the slider block and to urge the restriction member toward the guide fence, and a lever that is fixed with a second end of the restriction member and configured to swing the restriction member when manually operated to distance the restriction member away from the guide fence against an urging force of the elastic member.

3. The sheet supply device according to claim 2, wherein the guide fence lock mechanism is provided in a pair, and one guide fence lock mechanism of the pair is disposed at one side of the sheet supply tray with respect to the sheet supply direction, and another guide fence lock mechanism of the pair is disposed at another side of the sheet supply tray with respect to the sheet supply direction.

4. The sheet supply device according to claim 2, wherein an engagement hole is formed on the fulcrum plate, the first end of the restriction member is engaged with the fulcrum plate at the engagement hole, and the engagement hole functions as the fulcrum when the restriction member is swung.

5. The sheet supply device according to claim 2, further comprising a pinch plate fixed with the slider block and to be pinched together with the lever when the lever is manually operated.

6. A sheet supply device comprising:

a sheet supply tray on which sheets are intended to be stacked;

a guide fence for restricting positions of the sheets along a sheet width direction perpendicular to a sheet supply direction;

a slider block that is slidable along the sheet width direction and supports the guide fence in an upright state, the slider block including a protrusion protruding in a direction away from the guide fence;

a slide shaft that is inserted into a through hole formed in the slider block and guides sliding of the slider block along the sheet width direction; and a guide fence lock mechanism including an elastic member and a restriction member on which a hole is formed, the guide fence lock mechanism being attached to the slider block swingably at a position distanced from the guide fence, the slide shaft being inserted into the hole, wherein the guide fence lock mechanism is configured to restrict sliding of the slider block along the sheet width direction by holding the restriction member in a lock state where an inner circumferential edge of the hole is pushed onto an outer circumference of the slide shaft, and to allow sliding of the slider block along the sheet width direction when the restriction member is swung to cancel the lock state, and the elastic member is engaged with the restriction member and acts on the restriction member to urge the restriction member toward the guide fence.

7. The sheet supply device according to claim 6, wherein the guide fence lock mechanism further includes a fulcrum plate that is fixed with a first vertical end of the slider block and engaged with a first end of the restriction member so as to function as a fulcrum when the restriction member is swung, the elastic member that is disposed near a second vertical end of the slider block, and a lever that is fixed with a second end of the restriction member and configured to swing the restriction member when manually operated to distance the restriction member away from the guide fence against an urging force of the elastic member.

8. The sheet supply device according to claim 7, wherein the guide fence lock mechanism is provided in a pair, and one guide fence lock mechanism of the pair is disposed at one side of the sheet supply tray with respect to the sheet supply direction, and another guide fence lock mechanism of the pair is disposed at another side of the sheet supply tray with respect to the sheet supply direction.

9. The sheet supply device according to claim 7, wherein an engagement hole is formed on the fulcrum plate, the first end of the restriction member is engaged with the fulcrum plate at the engagement hole, and the engagement hole functions as the fulcrum when the restriction member is swung.

10. The sheet supply device according to claim 7, further comprising a pinch plate fixed with the slider block and to be pinched together with the lever when the lever is manually operated.

* * * * *